US005380968A

United States Patent [19]

Morse

[11] Patent Number: 5,380,968

[45] Date of Patent: Jan. 10, 1995

[54] PROTECTIVE COVER FOR SWITCHES

[75] Inventor: Milton Morse, Fort Lee, N.J.

[73] Assignee: A.P.M. Hexseal Corporation, Englewood, N.J.

[21] Appl. No.: 128,992

[22] Filed: Sep. 29, 1993

[51] Int. Cl.[6] ..... H01H 21/08

[52] U.S. Cl. ..... 200/302.3; 200/333

[58] Field of Search ..... 200/302.1, 302.2, 302.3, 200/331, 333; 74/17.8

[56] References Cited

U.S. PATENT DOCUMENTS

| | | | |
|---|---|---|---|
| 2,334,901 | 11/1943 | Bullergahn | 200/333 |
| 2,343,060 | 2/1944 | Horning | 200/302.2 X |
| 2,795,144 | 6/1957 | Morse | 74/17.8 |
| 2,984,725 | 5/1961 | Hubbell et al. | 200/302.3 |
| 3,090,855 | 5/1963 | Morse . | |
| 3,188,438 | 6/1965 | Lovaxo | 200/333 |
| 3,236,990 | 2/1966 | Bates | 200/302.3 |
| 3,668,938 | 6/1972 | Dimitry | 200/302.3 X |
| 3,778,577 | 12/1973 | Fromknecht et al. . | |
| 4,298,778 | 11/1981 | Beresford-Jones | 200/302.2 |
| 4,501,936 | 2/1985 | Morse | 200/333 X |
| 5,092,459 | 3/1992 | Uljanic | 200/302.2 X |

FOREIGN PATENT DOCUMENTS

| | | | |
|---|---|---|---|
| 48241 | 9/1932 | Denmark | 200/302.2 |
| 871287 | 4/1941 | France | 200/302.2 |

*Primary Examiner*—Renee S. Luebke
*Attorney, Agent, or Firm*—Arthur L. Plevy

[57] ABSTRACT

An elastomeric protective cover for use with an electrical switch of the type including a movable actuator, such as a rocker switch. A housing region of the protective cover defines an interior cavity for sealing and receiving a portion of the movable actuator of the switch. An interior surface of the cavity includes a projection such as a reinforcing rib which is positionable above the movable actuator. The projection coacts with the surface of the actuator upon application of tactile pressure near the engaging means which deforms the cover. The cover which is made from a flexibly resilient material returns to its original shape upon removal of the tactile pressure. The cover includes a flange for mounting the cover to the outside of a panel or other surface.

14 Claims, 3 Drawing Sheets

PROTECTIVE COVER FOR SWITCHES

PROTECTIVE COVER FOR SWITCHES

1. Field of the Invention

This invention relates generally to flexible protective sealing devices adapted to be positioned around the environmentally exposed portion of an electrical switch, and more particularly to an improved form of such device which allows for increased ease of operation of the switch.

2. Background of the Invention

In certain types of electrical switch structures which may be exposed to harsh industrial environments, it is desirable to provide a seal around the exposed portion of the switch in order that the interior of the switch may be protected from the entrance of foreign matter such as water, oil and dust. It is well known that seals for use with electrical switches may be fabricated from deformable elastomeric materials, such as silicone rubber, and that such seals made from these materials will deform upon contact from a positive force and then return to their original shape once the force is removed.

Many examples of seals for electrical switches may be found in the prior art. For example, U.S. Pat. No. 4,298,778 to Beresford-Jones entitled WATERPROOF SEAL FOR A PUSH-BUTTON discloses a waterproof seal for a push-button switch mounted in a panel. The seal disclosed in the Beresford-Jones patent comprises a cylindrical shroud of resilient material which is closed at one end. The closed end is collapsible inwardly and the open end is sealable to the panel. The seal is intended for protecting push buttons in control panels of watercraft and other vehicles exposed to wet conditions.

U.S Pat. No. 3,778,577 to Fromknecht et al. entitled MOISTURE SEALING DEVICE FOR TOGGLE SWITCHES discloses a cap and wall structure for sealing a toggle switch against entry of moisture. The cap comprises a skirt which encapsulates an annular wall formed about an opening in a wall structure or cover plate. A pair of tabs entrap and actuate the switch actuating member in response to movement of the cap.

U.S Pat. No. 3,090,855 entitled TRANSPARENT SWITCH BOOT and issued to the present inventor herein, discloses a hermetic boot for use in conjunction with a panel mounted push-button control. The switch comprises a mounting frame element and a boot element. The boot includes a plurality of groove and flange means engageable with portions of the mounting frame element. The switch boot forms a seal about the push-button control without the use of tools.

U.S. Pat. No. 2,795,144 entitled MOISTURE PROOFING DEVICE, and issued to the present inventor herein, discloses a flexible boot element having a hollow cavity and a nut means. The nut means engages a portion of the switch to be protected allowing the boot element to form a moisture proof seal over the switch to be protected.

None of the aforementioned prior art patents, however, addresses the special design needs of a switch boot or protective cover for a rocker switch, circuit breaker switch or another type of toggle switch. Referring to FIG. 1, there is shown a side view of an exemplary rocker switch 10 to be used in conjunction with the present invention. As can be seen the switch 10 includes a switch base 12 and a rocker arm 14 mounted inside the switch base 12. The rocker arm 14 pivots about a central axis 16 and can be changed from a first condition to a second condition by manipulating the rocker arm 14 back and forth. Connection terminals 18 are provided within the base 12 of the switch 10. The rocker arm 14 can be depressed in one direction to close contacts within the switch 10 and form a short circuit between the connection terminals 18. Alternately, the rocker arm 14 can be depressed in the opposite direction to open the switch contacts and create an open circuit between the connection terminals 18. The switch 10 can be toggled from a first condition to a second condition by depressing alternate ends of the rocker arm 14.

When rocker switches, such as that described in FIG. 1, are used with traditional switch boots of the prior art there is a tendency for one to have difficulty forcing the rocker arm 14 of the switch from a first position to a second position. That is, the rocker switch will only toggle into an opposite condition when force is applied directly to the outermost edges 20 of the rocker arm 14. Thus, selection of the location for placement of the force is extremely important and many times it will take more than one attempt to force the rocker switch 10 into the opposite mode. Having to make more than one attempt at altering the condition of a switch which is enclosed by a protective cover is jr inefficient and may even prove dangerous at times. For example, when a switch is only partially depressed in a specific direction or "teased" as a result of an incomplete switch closure, this teasing can cause arcing of the electrical current between the contacts of the switch, which may lead to burnout, a short circuit or other damage within the switch. A rocker or similar type switch may also control power to vital equipment such as pumps and other critical machinery, and such switches may be part of an emergency power shut off system. Thus, any delay associated with the operation of the switch can produce significant and possibly serious consequences.

Protective covers or switch boots of the prior art also have a tendency to be susceptible to uneven wear. That is the portion of the protective cover which is positioned above the outer edge of the rocker arm will have a tendency, to wear out much faster than the other portions of the protective device. This is because a majority of activating forces and related stresses are directed toward one specific area region of the device. The problem of uneven and premature wear significantly reduces the time for which a protective cover can adequately protect an electrical switch from foreign matter and other such contaminants.

Protective covers of the prior art do not always provide a tight and continuous seal around the switch opening which they are covering. Sometimes the seal which covers the outside of the panel is uneven or becomes loose over time because of the sealing mechanism employed. Accordingly, foreign matter and other contaminants can eventually leak behind the seal to damage the switch which is to be protected.

It is therefore an object of the present invention to provide an improved protective cover for a toggle switch in which a movable arm of the toggle switch may be more efficiently operated, than with protective covers of the prior art. It is also an objective of the present invention to enable easier operation of a toggle switch from a first condition to a second condition.

It is a further object of the present invention to provide a protective cover which minimizes the damaging effects of current arcing between switch contacts which are produced as a result of partial switch depression or switch "teasing".

It is a further objective of the present invention to provide a protective cover for a toggle switch which is less susceptible to the wear and tear placed on such a device.

It is a further object of the invention to provide an improved sealing mechanism for sealing around the opening in a panel wherein a switch is mounted.

SUMMARY OF THE INVENTION

The present invention discloses an elastomeric protective cover for use with a tactily manipulable electrical switch. The switch may be of a type including a movable actuator, such as the rocker arm of a rocker switch or circuit breaker switch. A housing region of the protective cover defines an interior cavity for sealably receiving a portion of the movable actuator of the switch. An interior surface of the cavity includes an engaging means or trigger mechanism for engaging a surface of the movable actuator. The engaging means may be a generally flat or other shaped projection such as a reinforcing rib member which is positionable above the movable actuator. The engaging means coacts with the surface of the actuator upon application of tactile pressure near the engaging means which deforms the cover. The cover, which is comprised of a flexibly resilient material, returns to its original shape upon removal of the tactile pressure. The cover includes mounting means, such as a flange, for mounting the cover to the outside of a panel or other surface.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Figure 1:
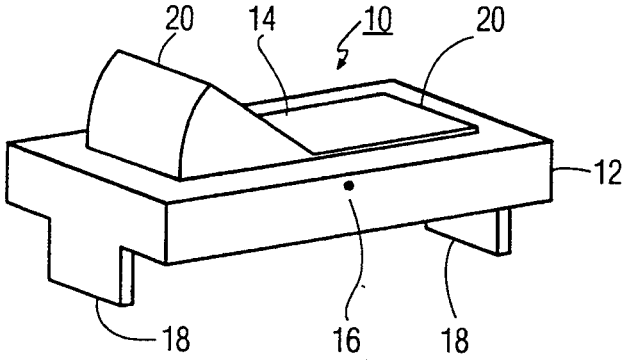
FIG. 1 PRIOR ART
FIG. 1 shows prior art of an exemplary rocker switch device used in conjunction with the present invention.
Figure 2:
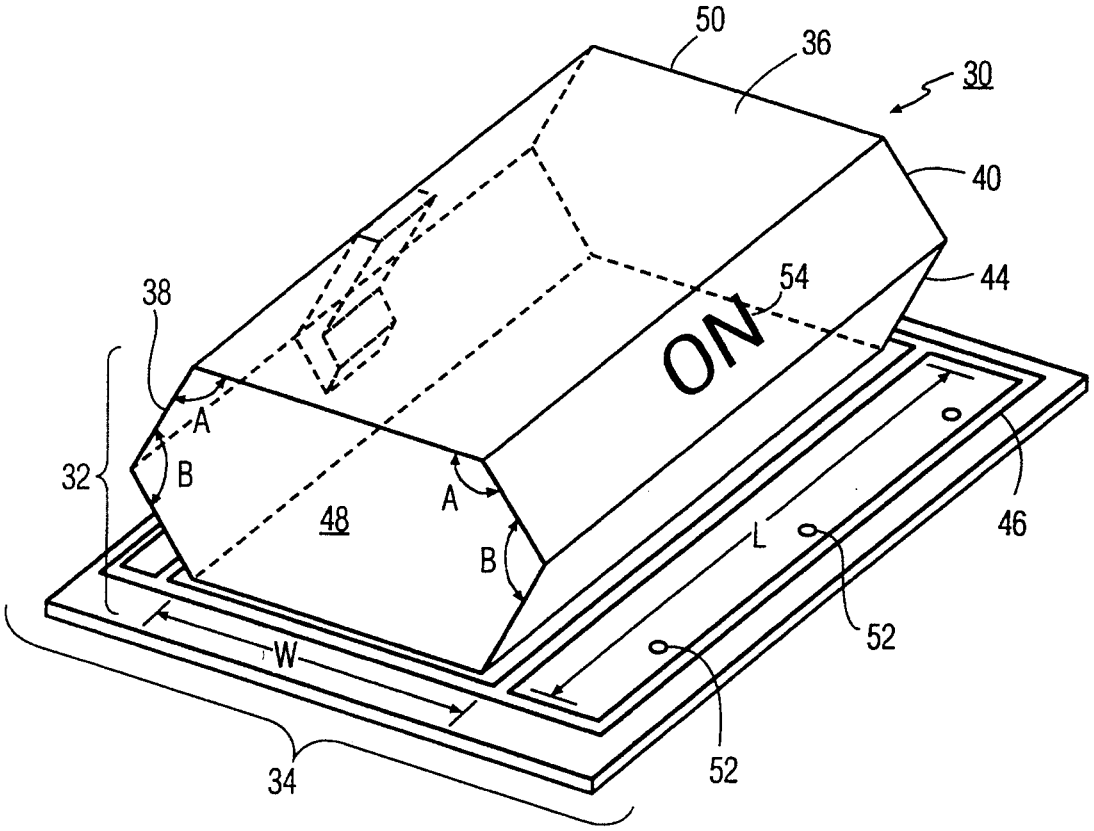
FIG. 2 is a perspective view of a first preferred embodiment of a protective cover according to the present invention.

Referring to FIG. 2, there is shown one preferred embodiment of a protective cover 30 for a rocker switch according to the present invention. The protective cover 30 is adapted for use with a rocker switch, as illustrated in FIG. 1, or any other similar type of toggle switch. Switches of this type are normally positioned within a rectangular opening in a panel or other surface. The protective cover 30 is then placed over the top of the rocker switch overlying the edges of the opening and contacting the outer surface of the panel.

The cover 30 of FIG. 2 generally comprises a housing 32 which is coupled to a base region 34. The housing 32 includes a series of walls which enclose a hollow region within the interior of the cover 30. The hollow region encompasses that portion of a switch extending beyond the panel or other surface where the switch is mounted. The housing 32 has a length L, a width W, which generally correspond to the dimensions of the switch to be protected. The housing contains a top wall 36, upper sidewalls 38,40 and lower sidewalls 42,44. The upper left and right sidewalls 38,40 are attached at an angle A to sides of the top wall 36. In the shown embodiment angle A is an obtuse angle of approximately 120 degrees. Lower sidewalls 42,44 are connected to each of the upper sidewalls 38,40 at an angle B and are further attached to a mounting flange 46. In the shown embodiment angle B is also an obtuse angle of approximately 120 degrees. Front and back walls 48,50 are attached to the respective ends of the aforementioned walls in order to enclose the hollow and form a hexagonal structure. The mounting flange 46 establishes the base 34 for the cover 30 to which the lower sidewalls 38,40 and the front and back walls 48,50 are connected. The mounting flange 46 is of a generally rectangular shape and surrounds the bottom portion of the cover 30. Mounting holes 52 are provided within the mounting flange 46 in order to facilitate attachment of the cover 30 to a panel or other surface. It will be understood that there are many other available provisions for mounting the protective cover, such as adhesive and other like methods, and that the flange with mounting holes is merely an exemplary attachment means. The top surface of the cover 30 may also include various forms of indicia 54, such as for example, the words "ON" or "OFF" or any other similar terminology. The indicia will serve to illustrate the direction for a desired operation to the switch.

Figure 3:
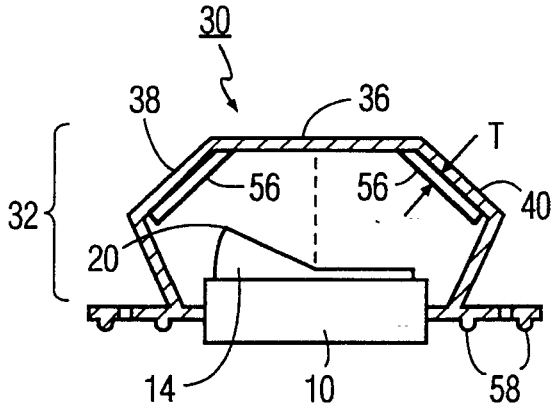
FIG. 3 is a cross sectional view of the first preferred embodiment of the protective cover, shown in conjunction with the rocker switch of FIG. 1 to facilitate consideration and discussion.

Referring to FIG. 3 there is shown a cross sectional side view of the protective cover 30 according to the present invention. The interior region of the top wall 36 and the upper side walls 38,40 include a trigger mechanism or engaging means 56 extending therefrom. In the shown embodiment, the engaging means 56 is a generally flat projecting member having a predetermined thickness T. With the inclusion of the projecting member, the protective cover 30 will have a substantially increased thickness in the region of the engaging means 56. The engaging means 56 and the protective cover 30 may be unistructurally formed, in which case, the engaging means and cover would be comprised of the same material, and wherein the structure could be fabricated from a mold type process. Alternatively, the engaging means 56 and cover 30 may be separately formed, in which case the structures can be made from different materials, the engaging means being a separate piece which is adhesively attached to the cover in a known manner. FIG. 3 also illustrates the existence of sealing members 58 which are located on the underside of the mounting flange 46. In the shown embodiment the sealing members 58 comprise a continuous raised bead that encircles the opening in the cover 30 and extend from the flange 46. The sealing members 58 flatten and press against the mounting surface to create a contaminant resistent seal as the cover 30 is secured into place. In this way an improved seal over that of the prior art is also created.

As can be seen from the FIG. 3 the protective cover 30 is placed directly over a switch 10 or series of switches. When pressure is applied to any region near the engaging means 56 the housing 32 will be deformed in responses to the pressure which is exerted. The generally flat projection of the engaging means 56 will in turn contact the rocker arm 14 of the switch 10 and engage the arm 14 to force it in the direction which the force is being applied. Inclusion of the engaging means 56 within the interior of the protective housing 32 greatly eases the operation of the protected rocker switch 10. Force need only be applied to the general area of the engaging means 56 in order to manipulate the rocker arm 14, and the switch 10 itself, into the opposite state. Accordingly, it is no longer necessary to pinpoint the location of the applied force at the exact edge 20 of the rocker arm 14 in order to change the condition of the switch 10. Upon removal of the applied force, the protective cover 30 will return to its original shape.

As viewed from the side, the housing 32 of the protective cover 30 is generally hexagonal in shape. The hexagonal shape allows for optimal placement of the engaging means 56 with respect to the operation of the rocker switch 10. It will be understood however, that the housing region 32 of the protective cover 30 need not be of a particular shape and inclusion of the engaging means 56 in housings of different shapes will also facilitate operation of a switch.

Figure 4:
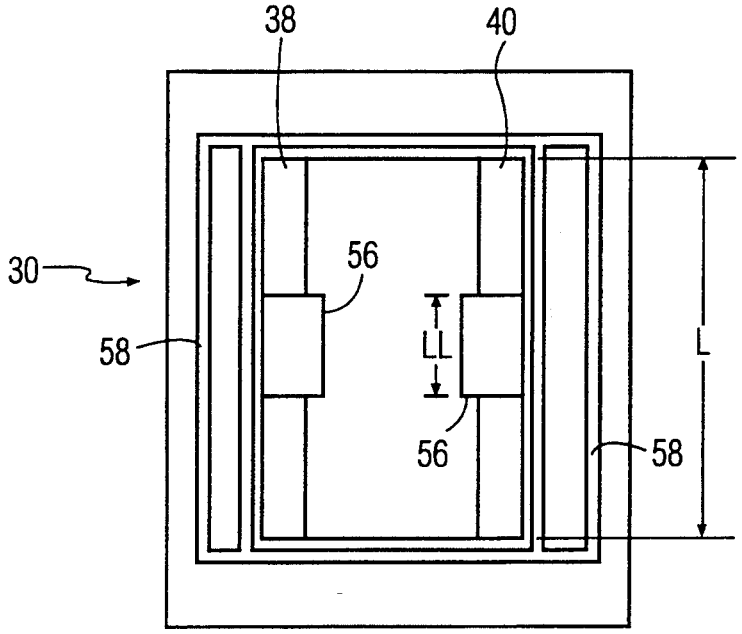
FIG. 4 is a bottom plan view of the first preferred embodiment of the present invention protective cover.

Referring to FIG. 4 in conjunction with FIG. 3, there is shown a bottom view of the present invention protective cover 30. As can be readily ascertained the engaging means 56 is disposed substantially in the center of each of the upper sidewalls 38,40 of the cover 30. The projection of the engaging means 56 has a length LL which varies according to the width of the arm 14 of the rocker switch 10. It will be understood that, depending on the location of a rocker switch within a panel, the engaging means 56 can be positioned anywhere along the length L of the upper sidewalls 38,40. It will also be understood that a protective cover 30 need not include an engaging means 56 for each condition of the switch to be protected. For instance, it may only be necessary to ensure quick and accurate activation of a switch in a single direction. An example would be the "OFF" condition for a switch that controls power to a critical area of a building or vital piece of equipment. It will also be understood that multiple engaging means 56 may be included on each of the side walls of a cover. In this way multiple switches, as are found in a switch bank of a control panel, can be efficiently activated and deactivated, as well as protected, through the use of a single protective cover. FIG. 4 also illustrates the placement of the sealing members 58 that extend from the underside of the mounting flange 46 and surround the opening in the cover 30.

Figure 5A:
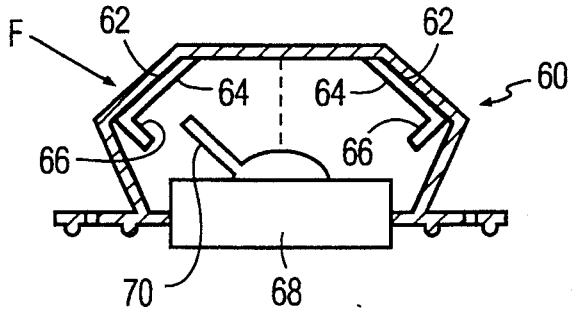
FIG. 5A is a cross sectional view of a second preferred embodiment of the present invention protective cover shown in conjunction with a circuit breaker switch to facilitate consideration and discussion.
Figure 5B:
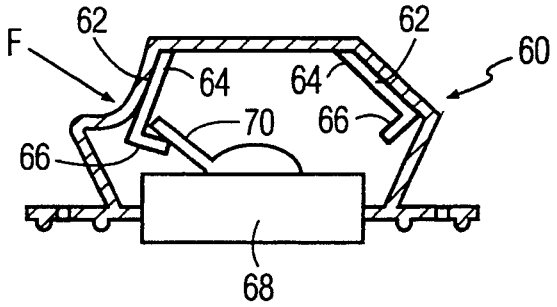
FIG. 5B is a cross sectional view of the second preferred embodiment switch cover shown in a deformed condition.

Referring to FIG. 5*a* there is shown a second preferred embodiment of a protective cover 60 according to the present invention. The cover is identical to the cover of FIGS. 2–4 with the exception that an engaging means 62 is an "L" shaped protrusion comprised of a base member 64 and an arm member 66. The arm member 66 is attached to an outward side of the base member 64 and extends therefrom at a generally right angle. The present embodiment protective cover 60 is useful for those types of switches 68 shown in FIG. 5, wherein the rocker arm is comprised of a flip tab member 70. Exemplary uses of such switches are for circuit breakers and other like devices. The L-shaped engaging means 62 of FIG. 5 operates in a similar fashion to the embodiments previously discussed. As force F is applied to a region near the engaging means 62, the base 64 and arm 66 of the engaging means 62 will contact the flip tab 70 on the switch 68 and force the tab 70 in the direction which the force is being applied. Referring to FIG. 5*b*, the second preferred embodiment of the protective switch cover 60 is shown in a partially deformed condition. As the combination downward and lateral force F is applied in a location proximate the engaging means 62, the protective cover 60 will deform, wherein the base 64 and arm 66 of the engaging means will contact the flip tab 70 of the switch 68. Continued application of the force F directs the flip tab 70 in the opposing lateral direction, thereby changing the state of the switch 68. Efficient operation of the circuit breaker type switch 68 is thereby enabled.

Figure 6:
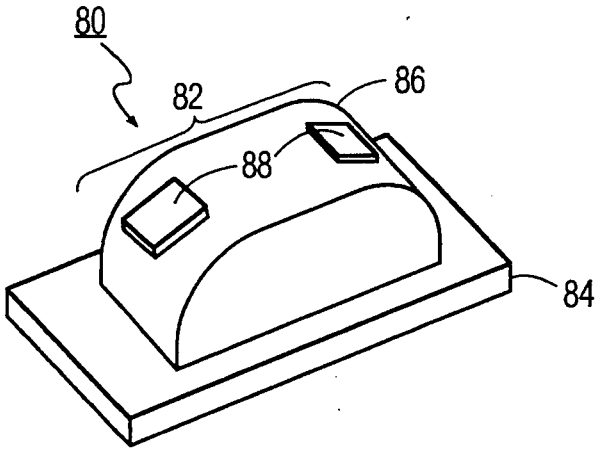
FIG. 6 is a perspective view of a third preferred embodiment of the present invention protective cover.

Referring to FIG. 6, there is shown a third preferred embodiment of the present invention protective cover 80. The protective cover 80 includes a housing region 82 and a base region 84 as with those embodiments previously described. The base region 84 of the present embodiment is adapted to engage the edges of a switch housing within which a rocker arm is mounted, to thereby create a moisture proof seal. The housing region 82 of the cover 80 is generally rectangular and may include rounded edges 86 at various locations thereof. The cover 80 includes engaging means 88 which are positioned to be directly above the ends of the rocker arm of a switch. Deformation of the protective cover 80 proximate the engaging 88 means acts to selectively operate the switch. It will be understood that the base and housing regions of the present invention protective cover may be of various differing geometries, sizes and proportions. For example, the present invention switch cover may be adapted to completely engulf the base and/or housing of the switch to provide a total seal of the panel opening. Also a protective cover may be adapted to engage an entire switch housing or part thereof, thereby providing a seal around exposed portions of the switch without having to mount the cover to a panel.

In addition to easing the operation of the rocker switch the present invention protective cover will better withstand normal wear and tear than the protective covers of the prior art. The engaging means acts to reinforce that area of the housing which is exposed to the most wear due to the application of applied forces. By including additional material in high wear areas, the length of the protection offered by the cover will be significantly increased.

The protective covers of the present invention will be manufactured from a flexible and resiliently deformable material such as silicone rubber or other like elastomeric material. The cover itself may be transparent or opaque. The invention may be unistructural or may be the product of multiple components. Thus, the covers can be manufactured using an injection mold process or other similar method. If in fact the cover is a composition of several pieces, the engaging means may be attachable and detachable depending upon the application.

It will be understood that the present invention protective covers described herein are merely exemplary and that a person skilled in the art may make many variations and modifications to the described embodiments utilizing functionally equivalent components to those described. As such, variation and modifications, including differing physical geometries, proportions and materials are intended to be within the scope of the invention as described in the appended claims.

What is claimed is:

1. An elastomeric protective cover for use in conjunction with a tactily manipulable electrical switch, said protective cover comprising:

a horizontal top wall;

a pair of inclined upper sidewalls depending from said top wall; and a projection means extending from an interior surface defined by said inclined upper sidewalls, whereby said projection means is adapted to engage a surface said tactily operated switch upon selective deformation of said cover.

2. The cover of claim 1, further including mounting means for sealably mounting said cover over said electrical switch to be protected.

3. The cover of claim 1, wherein an exterior surface of said cover includes indicia disposed thereon for directing operation of said switch.

4. The cover of claim 1, wherein said cover is transparent.

5. An elastomeric protective cover for covering a tactily manipulable electrical switch including a movable actuator, said cover defining an interior cavity for sealably receiving a portion of said movable actuator, said interior cavity being formed by a pair of inclined upper sidewalls and a pair of inclined lower sidewalls extending from said upper sidewalls at an obtuse angle, wherein an interior surface of said inclined upper sidewalls includes an engaging means for engaging a surface of said movable actuator, and whereby said engaging means coacts with said surface of said actuator upon application of tactile forces proximate said engaging means thereby altering the condition of said switch.

6. The cover of claim 5, further including mounting means for sealably mounting said cover over said electrical switch to be protected.

7. The cover of claim 6, wherein said mounting means includes a flange for sealably mounting said cover, said flange including a continuous raised bead projecting from an under surface thereof, said under surface facing away from said upper and lower sidewalls, said bead extending around said flange, wherein said bead creates a seal between said flange and a surface to which the switch is mounted to when said cover is installed over said switch.

8. The cover of claim 5, wherein the electrical switch is a rocker switch and said movable actuator is a rocker arm having two divergent faces, said engaging means being adapted to contact one of said divergent faces upon application of said tactile forces.

9. The cover of claim 5, wherein said engaging means has an increased thickness as compared to said cover alone to inhibit wear of said protective cover.

10. An elastomeric protective cover for use in conjunction with a tactily manipulable electrical switch which includes a pivotable actuator movable from a first position to a second position, said protective cover comprising:

a projection means extending from an interior surface thereof wherein said projection means includes a reinforcing rib member which is adapted to engage the actuator of the tactily operated switch upon selective deformation of said cover to move the actuator from the first position to the second position, wherein said rib member comprises at least one L-shaped projection.

11. The cover of claim 10, wherein said pivotable actuator of said electrical switch includes a flip tab, and wherein said L-shaped projection includes a base region and an arm member, said arm member being adapted to grasp said flip tab upon said selective deformation, causing lateral movement thereof from said first position to said second position.

12. The cover of claim 10, wherein said rib member has an increased thickness as compared to said cover alone to inhibit wear of said protective cover.

13. An elastomeric protective cover for covering tactily manipulable electrical switch including a movable actuator, said cover defining an interior cavity for sealably receiving a portion of said movable actuator, wherein an interior surface of said cavity includes an engaging means for engaging a surface of said movable actuator, whereby said engaging means coacts with said surface of said actuator upon application of tactile forces proximate said engaging means thereby altering the condition of said switch, wherein said engaging means includes at least one generally flat projection extending from said interior surface, said projection being positionable above said movable actuator, and wherein said generally flat projection further includes an arm member extending therefrom thereby forming an L-shaped protrusion, said L-shaped protrusion being positionable over said movable actuator.

14. The cover of claim 13, wherein said movable actuator includes a pivotable flip tab, said L-shaped protrusion of said cover being adapted to cause lateral movement of said flip tab upon application of said tactile forces.

* * * * *